US005649651A

United States Patent [19]

Lam

[11] Patent Number: 5,649,651

[45] Date of Patent: Jul. 22, 1997

[54] HANDICRAFT DISPLAY APPARATUS

[76] Inventor: Peter Ar-Fu Lam, 20104 Wayne Ave., Torrance, Calif. 90503

[21] Appl. No.: 375,534

[22] Filed: Jan. 19, 1995

Related U.S. Application Data

[63] Continuation-in-part of Ser. No. 273,311, Jul. 11, 1994, abandoned.

[51] Int. Cl.[6] ..... A47G 25/14

[52] U.S. Cl. ..... 223/85; 223/92

[58] Field of Search ..... 223/85, 88, 89, 223/92, 94, 95; D6/315, 328, 324, 325; 40/322, 1.5, 617

[56] References Cited

U.S. PATENT DOCUMENTS

| | | | |
|---|---|---|---|
| 901,901 | 10/1908 | Hornich | 40/322 |
| 3,467,291 | 9/1969 | Phillips et al. | 223/85 |
| 4,266,677 | 5/1981 | Dewsnap | 223/85 |
| 4,333,590 | 6/1982 | Princiotta | 223/85 |
| 4,497,124 | 2/1985 | Olive | 40/1.5 |
| 4,563,373 | 1/1986 | Barnett | 223/95 |
| 4,597,206 | 7/1986 | Benson | 40/1.5 |
| 4,756,104 | 7/1988 | Bailey | 223/85 |
| 5,056,248 | 10/1991 | Blanchard | 223/85 |
| 5,344,054 | 9/1994 | Nutter | 223/89 |

*Primary Examiner*—Bibhu Mohanty

[57] ABSTRACT

An apparatus especially configured to encourage children to produce and display handicraft works while also encouraging them to properly care for their articles of clothing. The embodiments include a frame member defining a display region configured for removably accommodating a child's handicraft. In a first embodiment, the frame member is especially configured for accommodating a substantially planar, i.e., two dimensional, handicraft in the display region. In a second embodiment, the frame member is configured for accommodating a three dimensional handicraft, e.g., a floral arrangement, in the display region.

10 Claims, 5 Drawing Sheets

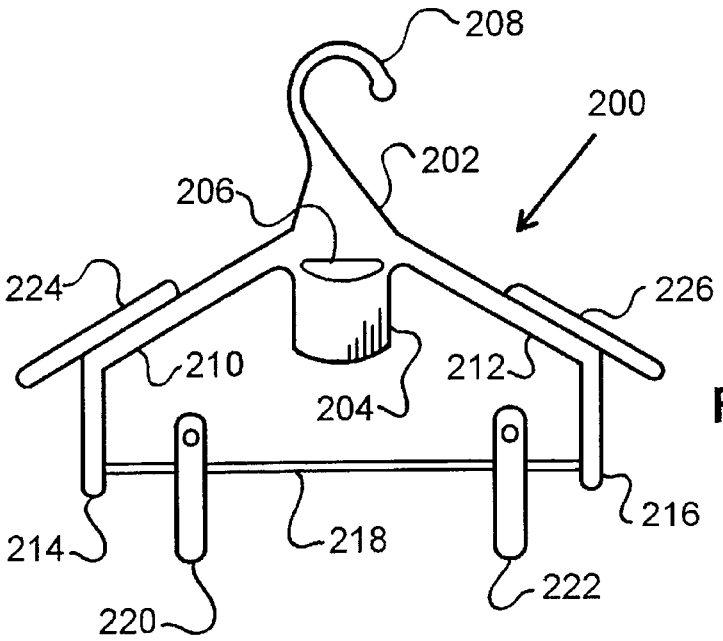
Figure 11
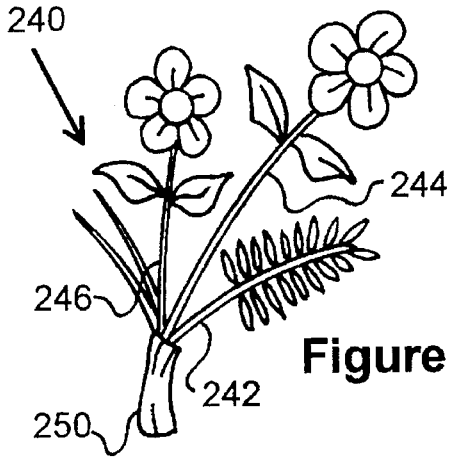
Figure 12
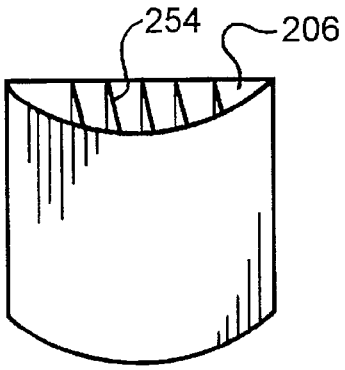
Figure 13
Figure 14
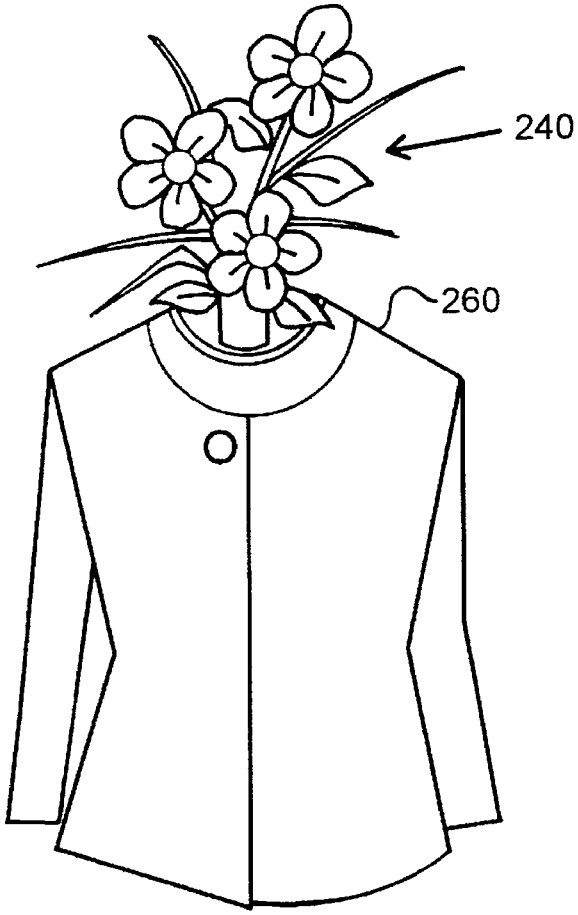

HANDICRAFT DISPLAY APPARATUS

RELATED APPLICATIONS

This application is a continuation-in-part of U.S. patent application Ser. No. 08/273,311 filed Jul. 11, 1994, now abandoned which is by reference incorporated herein.

BACKGROUND OF THE INVENTION

This invention relates generally to apparatus for displaying handicraft works and more particularly, to an article of manufacture especially configured for use by children for enabling them to decorate and personalize a device for supporting articles of clothing by displaying a handicraft thereon.

The prior art reveals many garment hangers suitable for use by children. For example only, attention is directed to the following U.S. Patents:

| | | |
|---|---|---|
| Des. 204,341 | 1,096,018 | 3,205,614 |
| Des. 158,922 | 3,126,237 | |

SUMMARY OF THE INVENTION

The present invention is directed to an apparatus especially configured to encourage children to produce and display handicraft works while also encouraging them to properly care for their articles of clothing. The embodiments of the invention include a frame member defining a display region configured for removably accommodating a child's handicraft. In a first preferred embodiment, the frame member is especially configured for accommodating a substantially planar, i.e., two dimensional, handicraft in the display region. In a second preferred embodiment, the frame member is configured for accommodating a three dimensional handicraft, e.g., a floral arrangement, in the display region.

In accordance with the preferred embodiments, first and second elongate arms extend in opposite directions from the frame member for supporting articles of clothing. Additionally, a hook member extends from the frame member for vertically suspending the frame member from a horizontally oriented support surface, e.g., on a stationary hook, a door top, or a rod.

In accordance with the first embodiment, the frame member defines the periphery of a display area for accommodating a substantially planar handicraft having a decorative front face such as a picture, drawing, painting, photograph or needlework. The frame member preferably includes a backing panel and a transparent display panel. The display panel is preferably configured for removable mounting on the frame member thus allowing the handicraft to be placed between the backing and display panels with its decorative front face visible through the transparent display panel.

In accordance with the second embodiment, the frame member defines a receptacle for accommodating a three dimensional handicraft such as a floral arrangement.

It is intended that emobidments of the invention include, i.e., be packaged together with, a set of craft materials for enabling a child to produce the handicraft to be accommodated in the frame member.

The novel features of the invention are set forth with particularity in the appended claims. The invention will best be understood from the following description, when read in conjunction with the accompanying drawings.

DESCRIPTION OF THE DRAWINGS

FIG. 11 is a plan view of a second preferred embodiment of the invention depicting a handicraft display apparatus including a receptacle for accommodating a three dimensional handicraft;

FIG. 12 depicts an exemplary three dimensional handicraft comprising a floral arrangement;

FIG. 13 is an enlarged isometric view depicting the receptacle of FIG. 11 and showing the utilization of partitions therein; and FIG. 14 is a front plan view of the display apparatus of FIG. 11 containing the floral arrangement of FIG. 12.

DETAILED DESCRIPTION

Figure 1:
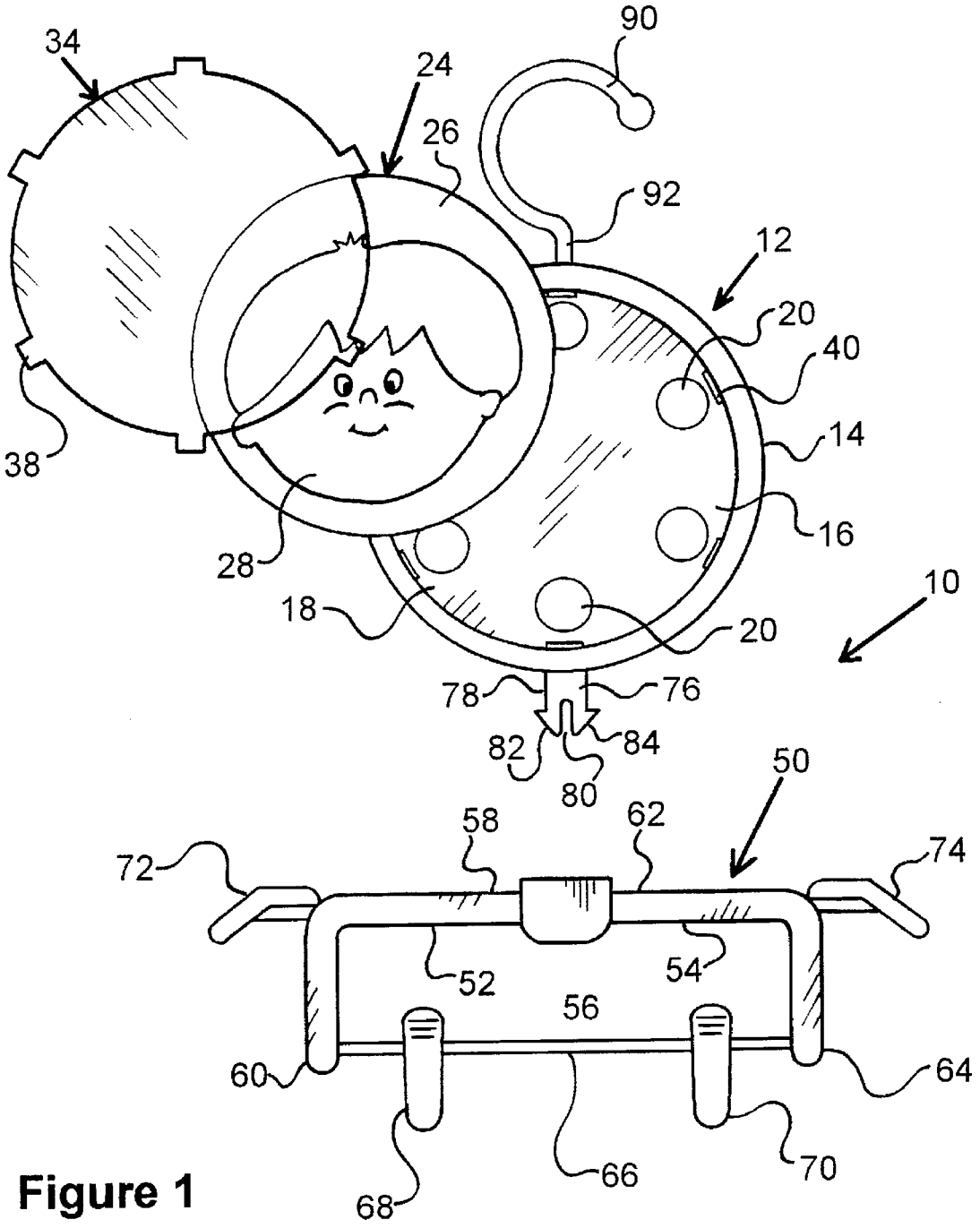
FIG. 1 is an exploded view of a first preferred embodiment of applicant's handicraft display apparatus.

Attention is initially directed to FIG. 1 which depicts an exploded view of a first embodiment 10 in accordance with the invention particularly configured to encourage a child to create and display a handicraft while also encouraging that child to properly care for his/her articles of clothing. The apparatus 10 is comprised of a frame member 12. The frame member 12 is formed by a substantially rigid peripheral member 14 which frames a display area 16. The peripheral member 14 is bridged by a backing panel 18. Holes 20 are preferably formed in the backing panel 18 to facilitate the removable mounting of a handicraft 24 in the display area 16 overlaying the backing panel 18.

Figure 8:
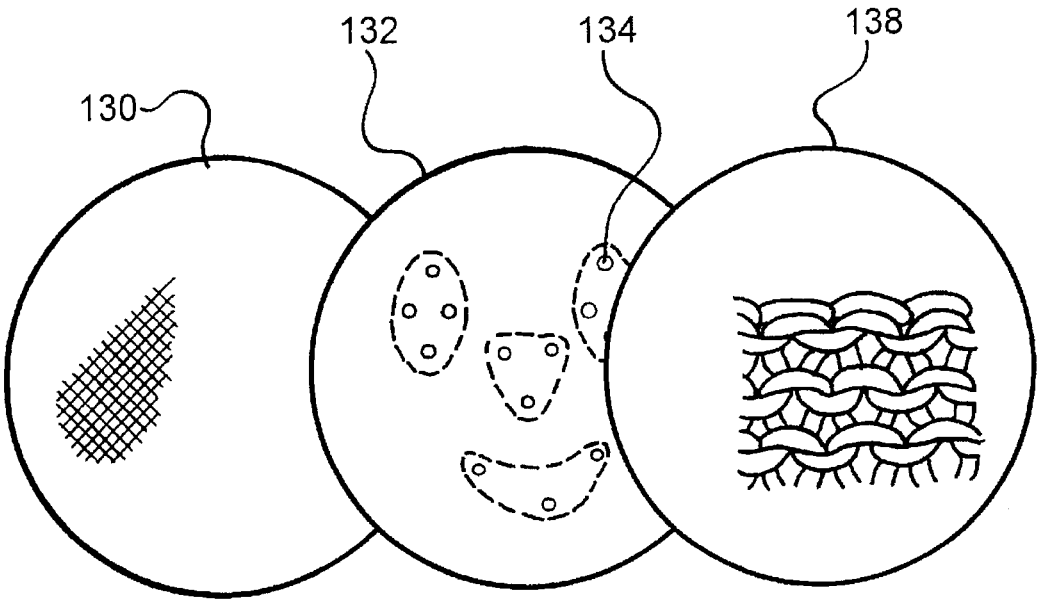
FIGS. 8, 9, and 10 depict a kit of exemplary elements which is preferably packaged together with the display apparatus for enabling a child to create a handicraft suitable for mounting in the display apparatus.
Figure 9:
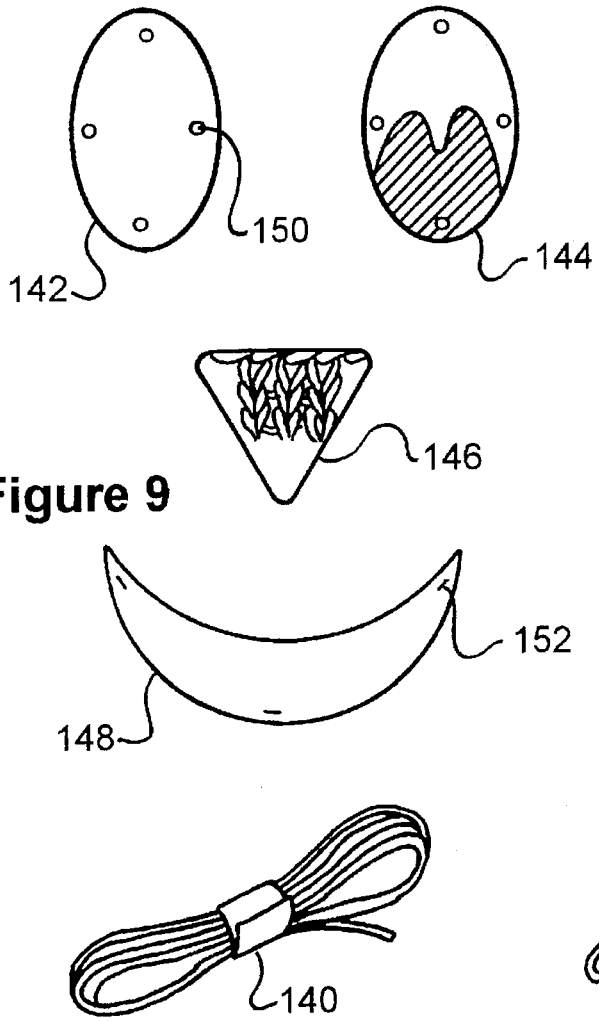
Figure 10:
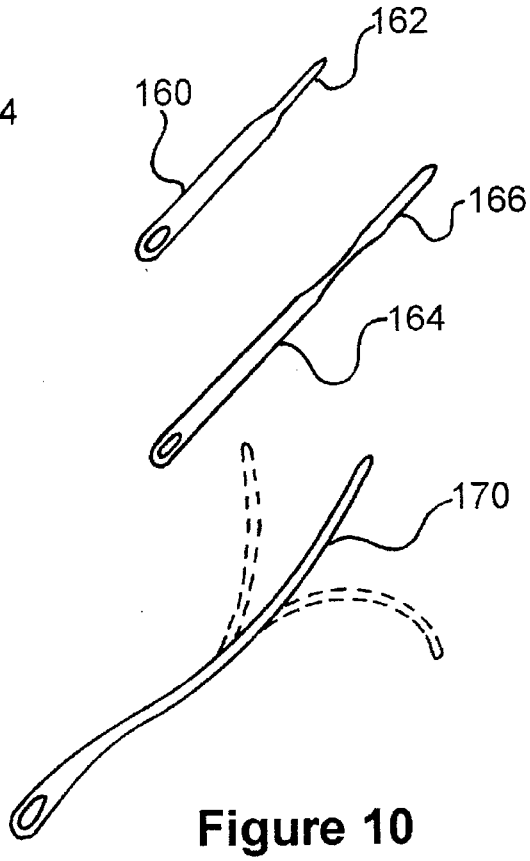

The term handicraft is defined by at least one of the two characteristics. Firstly, it is configured to exercise the creativity of the end user and secondly, it is intentionally configured to practice or express the skillful use of a hand. For the avoidance of doubt, the definition of handicraft excludes brand name logos, brand name labels, garment size indicia, or other materials not to be further manipulated by the end user. The handicraft 24 can comprise any of various planar structures having a front face 26 bearing a decorative pattern 28. The invention contemplates a great variety of decorative patterns and techniques for their formation. For example only, the handicraft 24 can comprise a picture, drawing, painting, photograph or needlework dimensioned to fit within the periphery defined by peripheral member 14. In perhaps its simplest form, the pattern 28 can be a hand drawing formed on a blank piece of paper. Alternatively, as will be discussed hereinafter, the pattern can be formed by various other craft techniques such as cutting out preprinted elements and adhering them to a base sheet (FIG. 4) and/or forming a handicraft using needlework techniques as are generally represented by FIGS. 8–10. It is intended that the display apparatus 10 be packaged as a kit together with craft materials for forming the handicraft.

As will be discussed hereinafter, it is intended that the handicraft 24 to be displayed be mounted against the backing panel 18 within the periphery defined by peripheral member 14. A transparent display panel 34 is provided and is intended for mounting on the frame member 12, sandwiching the handicraft 24 between the display panel 34 and backing panel 18, with the front face 26 of the handicraft 24 visible through the transparent display panel 34.

Figure 2A:
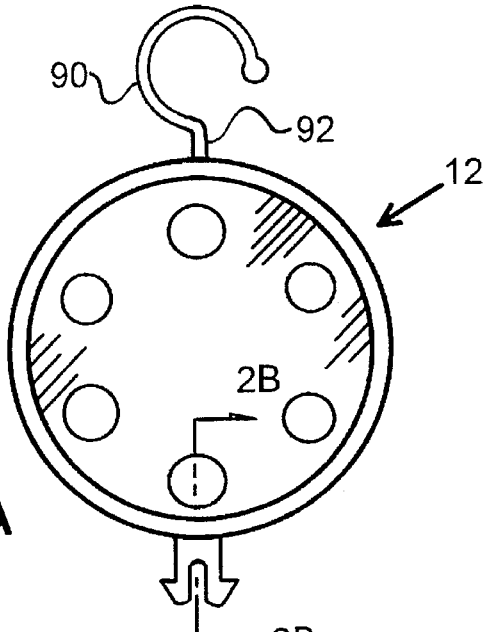
FIG. 2A is a front plan view of the frame member of FIG. 1.
Figure 2B:
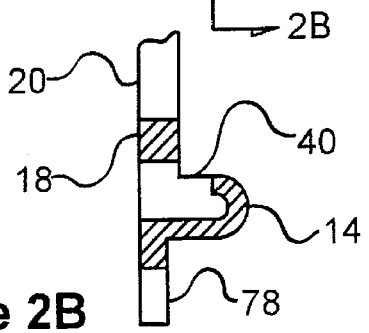
FIG. 2B is a sectional view taken substantially along the plane 2B—2B of FIG. 2A.

The display panel 34 is preferably provided with radially extending tabs 38 dimensioned and located to be removably received within mating slots 40 (FIG. 2B) defined between the backing panel 18 and the peripheral member 14.

The frame member 12 is configured for attachment to a device 50 for supporting clothing articles. The device 50 essentially is comprised of first and second arms 52, 54 which extend outwardly in opposite directions from a medial member 56. More particularly, arm 52 has a first end 58 secured to medial member 56 and a second substantially free end 60. Similarly, arm 54 has a first or inner end 62 secured to medial member 56 and a second free end 64. Ends 60 and 64 are preferably bridged by a bar 66 carrying spring urged clips 68, 70 suitable for holding a skirt or trousers. Extender members 72 and 74 are respectively mounted on arms 52 and 54 for extending the effective width of the device 50 to enable the device to grow with a child as the child's clothing size increases.

The frame member 12 is provided with a mounting member 76 for attaching the frame member to the device 50. More particularly, the mounting member 76 comprises a bifurcated stud 78 extending radially outward from the peripheral member 14. The stud is bifurcated by slot 80 which forms portions 82, 84 which can be resiliently urged together to enable them to pass into a slot (not shown) formed in medial member 56 for securing frame member 12 to device 50.

A hook member 90 having a shaft 92 also extends radially from the peripheral member 14, substantially diametrically displaced from the mounting stud 78.

Figure 3:
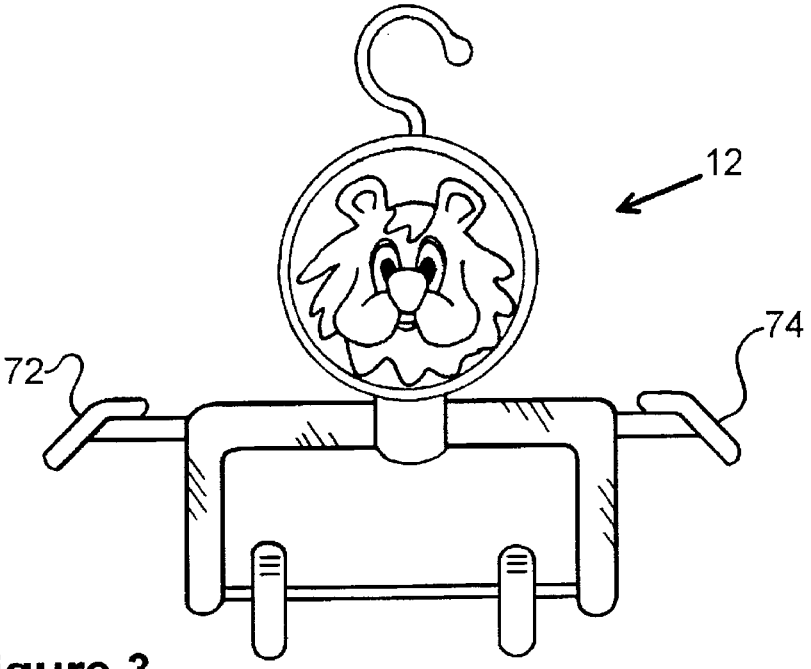
FIG. 3 is a front plan view of a fully assembled first preferred embodiment of the invention showing the extender members in their extended position.

FIG. 3 depicts the display apparatus of FIG. 1 in its fully assembled condition with its extender members 72, 74 fully extended.

Figure 4:
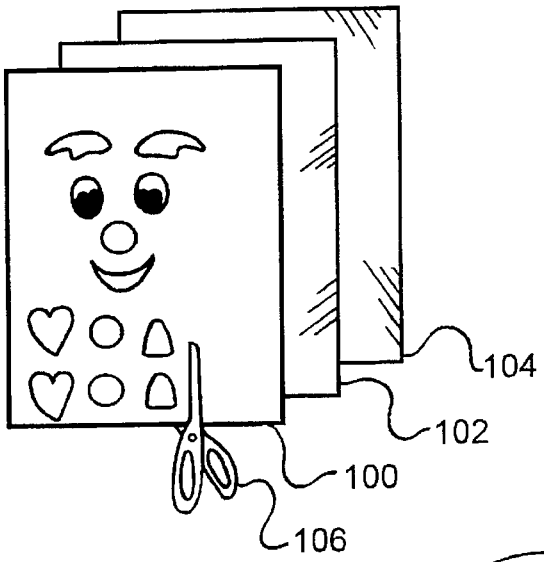
FIG. 4 schematically depicts various materials for use by a child to create a handicraft.
Figure 5:
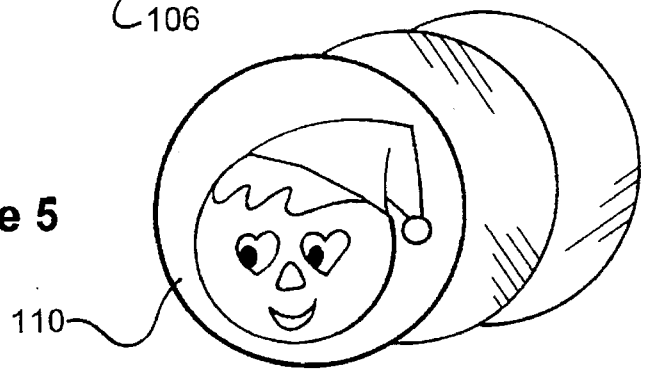
FIG. 5 depicts a child's handicraft created from the materials of FIG. 4.

FIG. 4 depicts a typical craft which can be utilized by a child to form a handicraft for display in the apparatus of FIG. 10. Note that various sheets of paper 100, 102, 104, preferably of different colors, can be provided, each bearing different elements of a picture or decorative pattern which can be utilized by a child user to form a composite design. By cutting out the selected elements utilizing scissors 106, the child is able to create the handicraft 110 depicted in FIG. 5.

Figure 6:
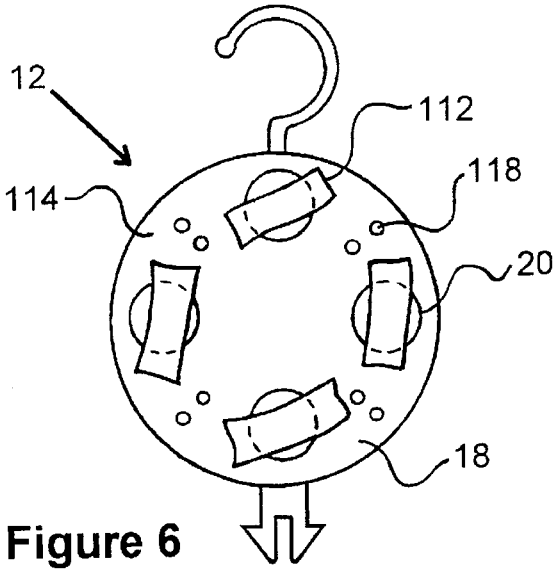
FIG. 6 depicts the rear view of the frame member showing one manner of removably mounting the handicraft in the frame member.

The handicraft 110 can be removably mounted in the frame member 12 as shown in FIG. 6. More particularly, pieces of adhesive tape 112 can be secured to the rear face 114 of the backing panel 18 across the holes 20. The adhesive face of tape 112 bears against the rear face 114 and extends through the holes 20 to engage and mount the rear face of handicraft 110.

Alternatively and additionally, pairs of small holes 118 can be provided in the backing panel 18 to permit a handicraft to be stitched to the backing panel.

Figure 7:
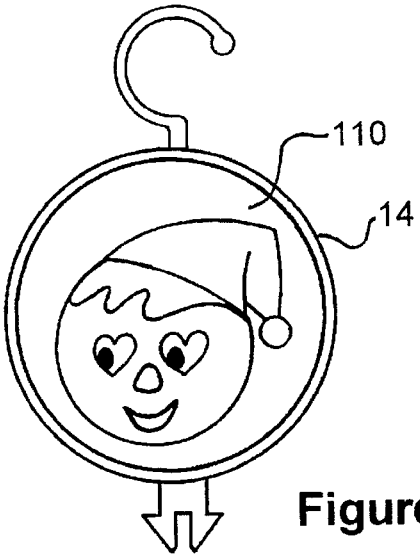
FIG. 7 is a front plan view of the frame member of FIG. 6.

FIG. 7 shows a front view of the frame member 12 displaying the handicraft 110 within the parameter of member 14. As has previously been discussed, a transparent display panel 34 is preferably used to overlay the handicraft 110.

FIGS. 8, 9 and 10 illustrate elements of a typical needlework art kit which can be provided with the apparatus 10 for encouraging a child to create an display handicrafts. FIG. 8 shows alternative base materials. For example, 130 represents a canvas or spongy backing material. 132 represents a fabric sheet preprinted with a pattern. Prepunched holes 134 are provided to facilitate the child's effort. 138 represents a knitted base material. FIG. 9 depicts yarn 140 which can be utilized by the child to apply various elements 142, 144, 146, 148 to the base materials such as 130, 132, 138. The elements depicted in FIG. 9 may be of particular shape and color and represent items such as eyes, noses, etc. These elements can also be provided with prepunched or cut apertures 150 or slots 152 to facilitate the child's work. FIG. 10 depicts typical needles for allowing the child to create the handicraft. Needle 160 is designed with a narrow elastic region 162 to minimize injury. Needle 164 is provided with a more rigid head 166 to facilitate stitching. A flexible child safe plastic needle is depicted in FIG. 10 at 170.

Attention is now directed to FIG. 11 which illustrates a second preferred embodiment of a display apparatus in accordance with the present invention. The apparatus 200 of FIG. 11 is comprised of a frame member 202 defining a pouch 204 forming an open receptacle 206. A hook 208 extends from the frame member 202 for suspending it from a horizontally oriented surface. First and second arms 210, 212 extend in opposite directions from the frame member 202 for supporting articles of clothing thereon. The arms 210, 212 respectively terminate at ends 214, 216. A rod 218 extends between ends 214 and 216 and supports spring urged clips 220, 222 for retaining skirts or trousers. Preferably, the arms 210, 212 also carry a adjustable extender members 224, 226 which enable the width of the apparatus 200 to be adjusted.

The receptacle 206 is configured to accommodate a three dimensional handicraft such as a floral arrangement 240, depicted in FIG. 12. The floral arrangement 240 is shown as being comprised of separate elements 242, 244, 246 which can all be inserted into the receptacle 206 separately, or bunched together by an appropriate tie 250. The receptacle 206 can be entirely open or can be partitioned by walls 254 as shown in FIG. 13.

FIG. 14, depicts an apparatus in accordance with the invention in its final form for displaying the floral arrangement 240 and for simultaneously supporting a clothing article 260.

From the foregoing, it should now be appreciated that applicant has disclosed herein embodiments of an apparatus which function to display handicrafts and which functions to support articles of clothing. It is intended that apparatus in accordance with the invention be utilized by parents to encourage children to create and display handicrafts while also encouraging them to properly care for their articles of clothing. It is contemplated that an apparatus in accordance with the invention be supported on a horizontal surface of a wall mounted hook member or a door top, preferably out of the closet. Although detailed embodiments of the invention have been disclosed, it is recognized that variations and modifications, all within the spirit of the invention, will occur to those skilled in the art. It is accordingly intended that all such variations and modifications be encompassed by the appended claims.

I claim:

1. An apparatus for displaying a handicraft, comprising:

a frame member defining a display region;

a handicraft dimensioned to be at least partially accommodated in said display region;

a hook member secured to said frame member and extending outwardly therefrom for vertically suspending said frame member from a horizontally oriented surface;

said frame member being configured to removably retain said handicraft in said display region; and first and second elongate arms respectively extending in opposite directions from said frame member for supporting an article of clothing.

2. The apparatus of claim 1 wherein at least one of said arms includes an elongate extender member mounted for adjustable movement along said arm.

3. The apparatus of claim 1 wherein said frame member is substantially planar and said display region comprises a display area; and wherein said handicraft is substantially planar and defines a front face bearing a decorative pattern.

4. The apparatus of claim 3 further including a transparent display panel; and means for removably mounting said display panel on said frame member so as to overlay said handicraft front face.

5. The apparatus of claim 4 wherein at least one of said arms includes an elongate extender member mounted for adjustable movement along said arm.

6. An apparatus for displaying a handicraft, comprising:

a frame member defining a receptacle for accommodating a three dimensional handicraft;

a three dimensional handicraft dimensioned to be at least partially accommodated in said receptacle;

a hook member secured to said frame member and extending outwardly therefrom for vertically suspending said frame member from a horizontally oriented surface;

said frame member being configured to removably retain said handicraft in said receptacle; and first and second elongate arms respectively extending in opposite directions from said frame member for supporting an article of clothing.

7. The apparatus of claim 6 wherein at least one of said arms includes an elongate extender member mounted for adjustable movement along said arm.

8. The apparatus of claim 6 wherein said handicraft comprises a floral arrangement.

9. A kit for creating and displaying a handicraft comprising:

a frame member defining a display region;

a collection of materials capable of being manipulated by an end user (a child) to form a handicraft dimensioned to be at least partially accommodated in said display region;

a hook member secured to said frame member and extending outwardly therefrom for vertically suspending said frame member from a horizontally oriented surface;

said frame member being configured to removably retain said handicraft in said display region; and first and second elongate arms respectively extending in opposite directions from said frame member for supporting an article of clothing.

10. The apparatus of claim 9 wherein at least one of said arms includes an elongate extender member mounted for adjustable movement along said arm.

* * * * *